United States Patent [19]

Knudtson et al.

[11] 4,258,651

[45] Mar. 31, 1981

[54] APPARATUS FOR APPLYING SEALANT TO THE IRREGULAR SIDE EDGES OF A PANEL

[76] Inventors: Brice N. Knudtson, 93100 McArthur La., Chesire, Oreg. 97419; Stanley B. Knudtson, 93022 Highway 99; Byron L. Knudtson, 93517 Prairie Rd., both of Junction City, Oreg. 97448

[21] Appl. No.: 77,755

[22] Filed: Sep. 20, 1979

[51] Int. Cl.[3] ..... B05C 1/02; B05C 11/02

[52] U.S. Cl. ..... 118/114; 118/122; 118/224; 118/DIG. 9

[58] Field of Search ..... 118/114, 103, 121, 122, 118/DIG. 9, 224, 102; 427/284, 359

[56] References Cited

U.S. PATENT DOCUMENTS

| | | | |
|---|---|---|---|
| 800,758 | 10/1905 | Neville | 118/DIG. 9 |
| 2,167,063 | 7/1939 | Brand | 118/DIG. 9 |
| 2,360,918 | 10/1944 | Wade | 118/114 X |
| 2,905,141 | 9/1959 | Young | 118/244 |
| 3,736,901 | 6/1973 | Aspenson | 118/114 X |

*Primary Examiner*—John P. McIntosh
*Attorney, Agent, or Firm*—James D. Givnan, Jr.

[57] ABSTRACT

An apparatus for treating the surfaces of a panel with irregular sides. Sealant is pressurized by applicator rolls acting on the top and bottom faces of the panel while sealant, deposited on the panel sides, is dispersed thereover by the side located spreader rolls. Side applicator rolls are stationed in series along each side of the moving panel with a first series of rolls each having an annular portion for pressuring sealant into the surfaces of the grooved side of the panel. Similarly the tongue side of the panel is sequentially treated by the rolls of a second series each having a circumferential recess within which is received the tongue of the remaining panel side. Additional rolls surface treat the panel faces. The side applicator rolls are biased into panel side engagement by spring assemblies which couple opposed side applicator rolls to one another to permit same to accommodate a moving panel with uniform pressure regardless of discrepancies in the panel path.

8 Claims, 9 Drawing Figures

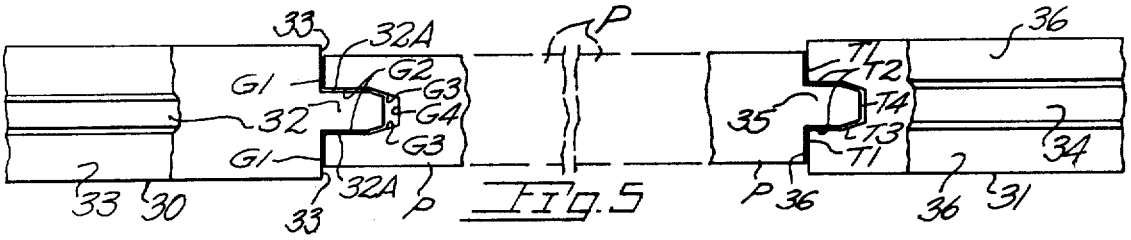
FIG. 5
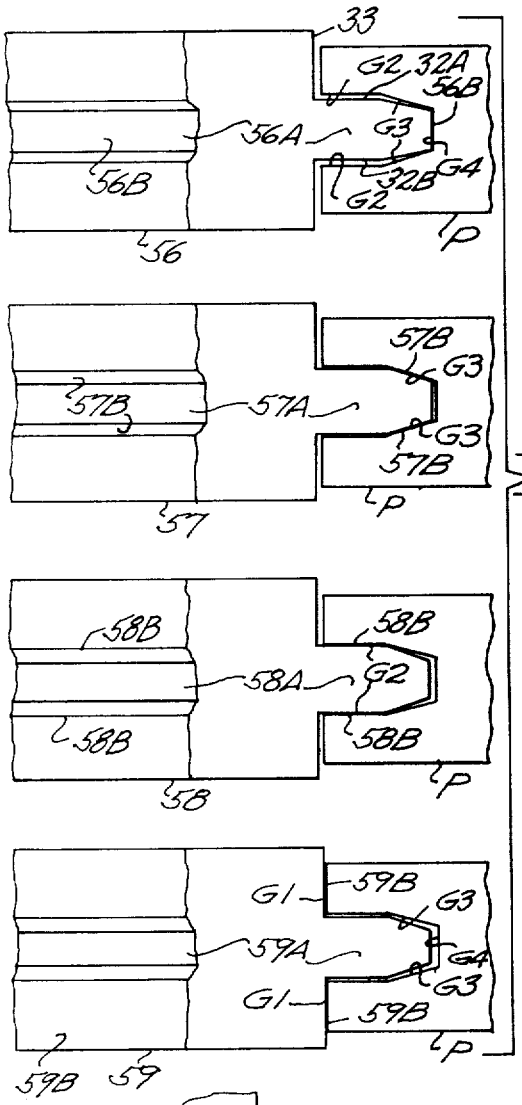
FIG. 6
FIG. 7
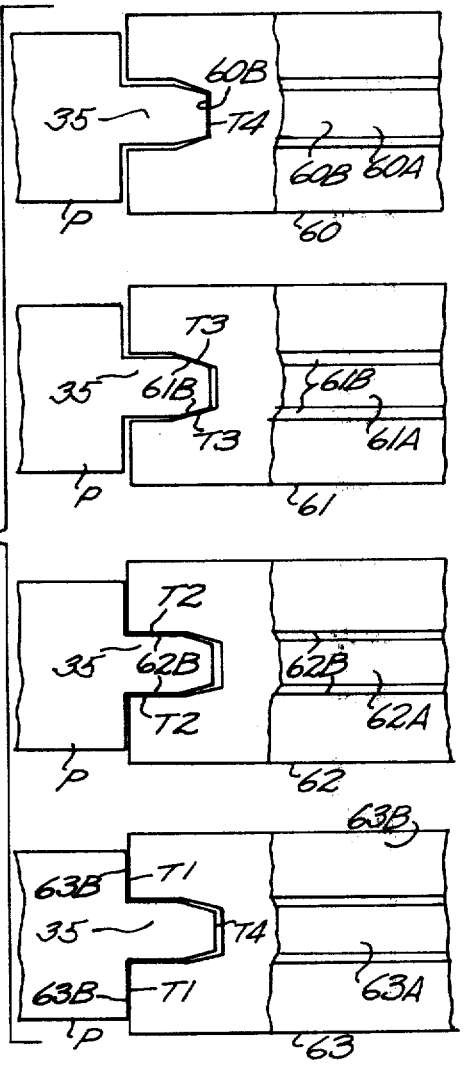
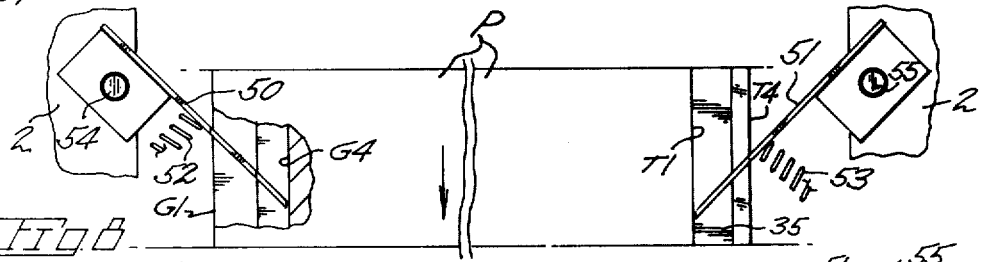
FIG. 8
FIG. 9
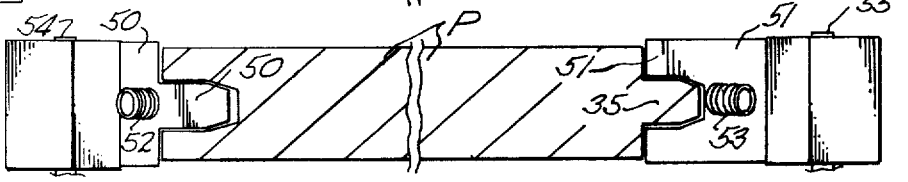

APPARATUS FOR APPLYING SEALANT TO THE IRREGULAR SIDE EDGES OF A PANEL

BACKGROUND OF THE INVENTION

The present invention pertains generally to apparatuses for applying fluid material to panels and particularly to an apparatus capable of treating panels with irregular side edges.

In use for some years now are panels fabricated from wood waste including sawdust, chips, and random shaped and sized particles. Such panels are termed particle board in the wood products industry. During fabrication of the panels, the wood particulate with a binder is subjected to heat and pressure for the purpose of providing a panel of the density desired.

A demand presently exists for particle board suitable for use in exterior construction applications such as in building walls. A problem is encountered however when particle board is used exteriorly in that the fibrous nature of the particle board renders same susceptible to moisture absorption. Entry of moisture into any portion of the panel results in swelling of same and eventual panel deterioration with adverse effects being imparted to associated building components.

Various solutions have been tried without a great deal of success. While sealant may be suitably applied to the major or top and bottom planar faces of a particle board panel using conventional roll means, a particularly troublesome area to seal has been the tongue and groove side edges of a panel which edges are intended for mated engagement with adjacent panels. Failure to fully seal such an edge renders the panel susceptible to absorption which generally occurs in a gradual manner after panel installation and entailing substantial replacement effort and cost.

Efforts to remedy the problem by applying excessive sealant to the irregular panel edges interferes with the necessary nicety of fit during later mating of panel edges at a job site.

Further, the application of sealant to panel edges by spray application has not proved acceptable since such application does not adequately surface coat the panel nor physically impregnate sealant into the outer boundary area of the panel. The application of sealant by means of a curtain coater has also proved to provide less than acceptable sealant application.

Prior art of some interest includes U.S. Pat. Nos. 2,682,254 and 2,905,141, both disclosing a single adhesive carrying applicator roll having a peripheral surface shaped for light adhesive transferring contact with the finger shaped end of a piece of lumber to be end spliced. Such an arrangement is not suitable for the pressured application of a viscous liquid to the irregular sides of a panel wherein dimensional changes can occur. U.S. Pat. No. 2,811,133 discloses an apparatus for color coating a peripheral beveled edge of accoustical tile with no provision made for the remaining side surfaces. U.S. Pat. No. 3,875,897 discloses a lumber jointer and coater for trueing the edges of a lumber strip and thereafter applying glue to the edge by means of doctor and applicator rolls with no provision made for imparting viscous material to an irregular lumber side edge.

SUMMARY OF THE PRESENT INVENTION

The present invention is embodied in an apparatus for applying viscous liquid sealant to surfaces of a panel.

Top and bottom faces of the panel may be sealed with conventional applicator rolls extending transversely across the panel faces. Sealant accumulating on the panel sides is conveniently applied to the multiple, contiguous, angularly related surfaces making up the sides of a tongue and groove panel by spreader means shown as rolls and, alternatively, as spreader arms.

Side rolls of the apparatus are located in series so as to be contacted by the panel sides. Sealant on the panel sides is acted on by the side rolls each being specifically configured for sealant application with multiple rolls of a series acting in concert to fully treat the entire side of the panel.

Important objectives of the present apparatus include the provision of an apparatus for sealing external panel surfaces having irregular sides as viewed in section; the provision of an apparatus utilizing spreader rolls or the like engageable with tongue and groove side edges of a moving panel to distribute a sealant therealong; the provision of an apparatus for treating panels of pressed wood particulate to render the panel virtually moisture proof to permit panel use in exterior wall applications; the provision of an apparatus including multiple side rolls located along and sequentially engaging a panel side edge to impart a viscous sealant thereto; the provision of an apparatus accomplishing the foregoing yet maintaining panel edge configuration and dimensions to enable desired interfitting at a job site of the edges of mated panels; the provision of an apparatus for sealing irregular sides of panels regardless of slight dimensional changes therein between panel production runs.

BRIEF DESCRIPTION OF THE DRAWINGS

In the accompanying drawings;

FIG. 5 is a vertical sectional view taken along line 5—5 of FIG. 1 and showing side located spreader rolls engaged with the panel sides;

FIG. 6 is a fragmentary elevational view of a series of side located pressure rolls for sequentially applying sealant to the groove edge of a panel;

FIG. 7 is a fragmentary elevational view of a series of side located pressure rolls for sequentially applying sealant to the tongue edge of a panel;

FIGS. 8 and 9 are respectively a plan view and an elevational view of spreader arms acting on panel side edges.

DETAILED DESCRIPTION OF THE PREFERRED EMBODIMENTS

Figure 1:
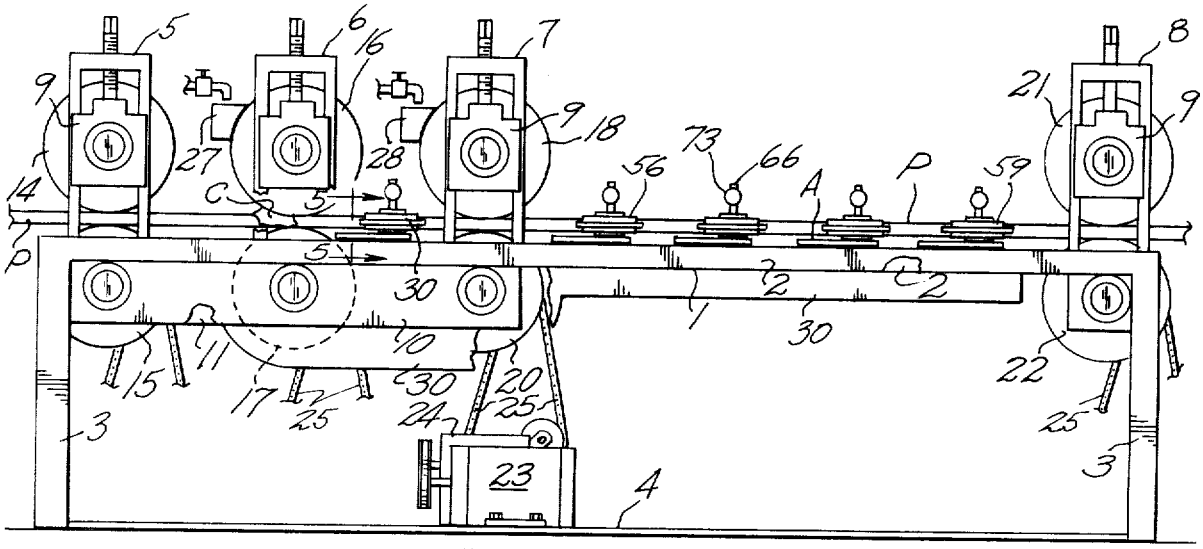
FIG. 1 is a side elevational view of the present apparatus.

With continuing attention to the drawings wherein applied reference numerals indicate parts similarly hereinafter identified, the reference numeral 1 indicates a table or base of the present apparatus which is of frame construction having longitudinal side members 2, legs 3 and a platform 4. In place on each of the side members 3 are pairs of bearing stanchions at 5, 6, 7 and 8. Each bearing stanchion adjustably carries a bearing block as at 9 suitably provided with a bearing within which is journalled the shaft end of a later described roll. Base 1 is also provided with opposed bearing plates 10 and 11 which serve to support additional bearings and the shaft ends of rolls cooperating with the above mentioned rolls.

Upper and lower transfer or feed means are shown as rolls indicated at 14 and 15 while applicator means, shown as rolls, are indicated at 16–17 and at 18–20. Upper and lower finish rolls are indicated at 21–22.

Shown in FIG. 1 are typical roll drive means including a motor 23 in driving coupled engagement with a speed reducer 24 which in turn drives a roller chain 25 reversely entrained about sprockets as at 26 on the shaft ends of rolls 18 and 20. Obviously, other roll drive arrangements are entirely feasible other than the one typical roll drive described. From the above it will be seen that rolls 14–15; 16–17; 18–20; 21–22 are of the powered direct drive type in pressure contact with the panel P being treated.

Top mounted applicator rolls 16 and 18 are supplied with panel sealant (or other liquid being applied) by means of open sided tank at 27 and 28 respectively. Their companion or lower rolls at 17 and 20 are supplied with sealant by means of a reservoir 30 within which each lower roll is partially submerged. Accordingly, companion rolls 16, 17 and 18, 20 apply sealant to the top and bottom faces of a panel P. Roll pressure desirably varies between the two pairs of applicator rolls with the first pair 16–17 being in heavier biased contact with the panel faces to promote greater sealant penetration while the second pair of applicator rolls, i.e., 18, 20, are in lighter biased contact to deposit a thin layer of sealant coating. In certain instances, one pair of applicator rolls may be entirely adequate.

A small build-up or collection C of sealant is formed immediately ahead of the juncture of roll 16 and the upper face of the panel which results in a flow of the sealant over and down the opposite side edges of the panel. To effect such flows, roll 16 is coterminous with the panel side edges or may extend therebeyond. Initial sealant application to the panel sides may be by other means such as a nozzle discharged stream.

Figure 2:
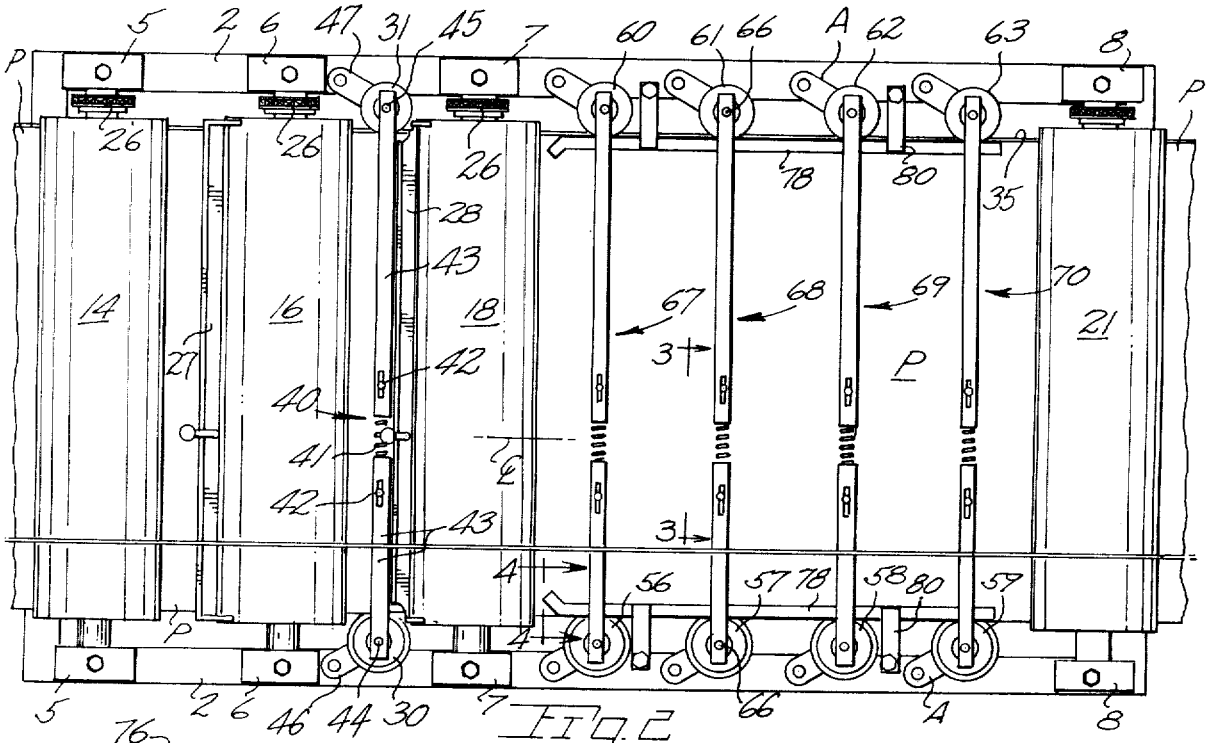
FIG. 2 is a plan view of FIG. 1 sectioned for illustrative purposes.

Offset in the direction of panel travel from companion applicator rolls 16–17 are spreader means 30 and 31 shown in FIG. 2 as side located rolls. Spreader rolls 30 and 31 are best shown in FIG. 5 in detail and serve to disperse the sealant flow as above deposited onto all of the surfaces constituting the panel sides which in a tongue and groove type panel are several. Side surfaces on the panel grooved side are G1; G2; G3 and G4 while surfaces on the tongue side of the panel are at T1; T2; T3 and T4.

With attention again to the spreader rolls 30 and 31 and specifically roll 30, the same as viewed in FIG. 5 includes an annular projection 32 projecting from an outer roll wall 33. Projection 32 is adapted for rolling insertion within the panel groove and in so doing carries a quantity of sealant for deposit in the extremity of the groove. Upper and lower projection surfaces 32A are in wiping contact with corresponding groove surfaces G2 to spread sealant thereto while outer wall 33 of spreader roll 30 is in rolling contact with panel surfaces G1.

Remaining spreader roll 31 includes an annular recess 34 for reception of the panel tongue 35. Sealant flowing over and down the panel side, as above described, is dispersed over the tongue edge of the panel by the action of roll 31 as adequate clearance exists between panel tongue 35 and annular roll recess 34 to permit roll urged migration of the sealant fully over the panel tongue side surfaces. Outer walls 36 of spreader roll 31 disperse sealant along panel tongue edge surfaces T1. Clearance between roll 31 and the tongue surfaces T2; T3 and T4 is such as to permit sealant dispersal thereon. The function of the spreader rolls 30 and 31 is to assure the dispersal of the sealant on and within the composite irregular side edges of the tongue and groove panel. The spreader rolls may be replaced by rolls of other configuration to best suit the edge configuration of the panel being treated.

Spreader rolls 30–31 are in biased engagement with the panel edges by biasing means generally at 40 including tensioned coil spring 41 having its ends adjustably secured at 42 to exert tension on tubular segments 43 and ultimately bias spreader rolls 30 and 31 inwardly by acting on roll axles 44 and 45. Arcuate motion of rolls 30 and 31 is permitted by swingably mounted brackets 46 and 47 affixed to the machine side members.

The spreader means may be otherwise embodied such as in FIGS. 8 and 9 wherein side located arms 50–51 each terminate for wiping contact with an opposite panel edge and are configured for spreading the liquid sealant onto the tongue and into the groove edge surfaces of a panel. Springs at 52–53 urge the arms into panel edge contact about pivot pins 54–55.

With attention to FIG. 6, a first series of side applicator pressure rolls are shown for treating the groove side of a tongue and groove panel while FIG. 7 shows a similar or second series of pressure rolls associated with the tongue side of the panel.

With attention to the groove applicator rolls of FIG. 6, as indicated at 56, 57, 58 and 59, each roll includes an annulus 56A, 57A, 58A and 59A each annulus being of somewhat different configuration for the purpose of biased contact with a specific surface or surfaces defining a portion of the panel groove. Annulus 56A has an outer vertical wall 56B for contact with panel groove surface G4; annulus 57A has inclined walls 57B for contact with inclined groove surfaces G3; annulus 58A has upper and lower horizontal walls 58B for contact with horizontal groove vertical walls G2 while roll 59 has wall surfaces 59B which contact panel side surfaces G1.

As the panel side has previously received an application of dispersed sealant (or other liquid being applied) as earlier described, the function of the side rolls 56–59 is to sequentially apply pressure to each of the groove side surfaces to impregnate the outer surface layer of same with the sealant. Important to such sealant application is the retention of groove dimensions as any reduction thereof by a collection or bead of sealant could jeopardize later tongue and groove engagement.

Tongue applicator rolls at 60, 61, 62 and 63 comprise a second roll series and function in a manner similar to the first series but with respect to surfaces at T1–T4. Each tongue applicator roll defines an annular recess at 60A, 61A, 62A and 63A with each recess defined by somewhat different wall configuration for purposes of biased contact with a specific surface or surfaces of the tongue side of the panel. Annular recess 60A of roll 60 has an inner vertical wall 60B for surfacial rolling contact with outermost tongue surface T4; annular recess 61A of roll 61 is defined by inclined walls 61B acting on tongue surfaces T3; annular recess 62A of roll 62 is defined by upper and lower horizontal walls 62B for contact with horizontal tongue surfaces T2 while roll 63 has vertical walls 63B for contact with panel side surfaces T1. The panel edge is accordingly sequentially impregnated with sealant leaving no objectionable residue or bead of sealant on the tongue side surfaces of the panel.

The side applicator rolls 56–59 and 60–63 are movably supported by base maounted arms A (FIG. 2) pivotally mounted on the base side members 2 with the distal arm ends each supporting a roll axle shaft as at 66. Each roll 56–59 and 60–63 is suitably journalled on its axle shaft with provision also made for a limited range of vertical displacement of each roll to accommodate slight variances in different production runs of panels. Interchanging with substitute rolls of different configuration enables other panel sealant application.

Biasing means for urging the side applicator rolls 56–59 and 60–63 toward their respective panel edges are embodied in spring assemblies generally at 67–70 which individually act on opposed side applicator pressure rolls as, for example, spring assembly 67 jointly urges rolls 56 and 60 into panel side engagement. Biasing forces of spring assembly 67 are evenly imparted to rolls 56 and 60 regardless of any lateral offset of the panel from a desired course such as is compensated for by the simultaneous shifting of the rolls 56 and 60 relative the longitudinal axis of the apparatus. The same is also true of remaining associated rolls 57, 61; 58,62 and 59,63.

Figure 3:
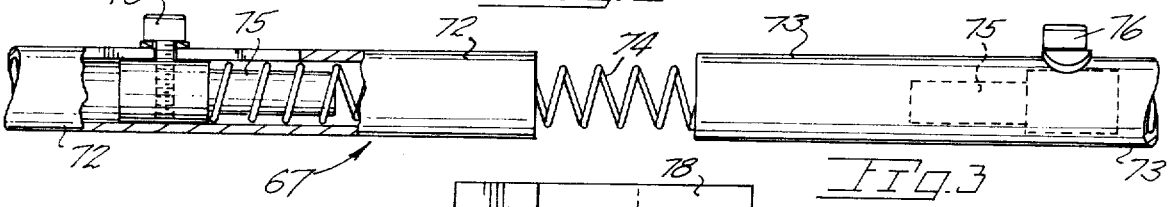
FIG. 3 is a fragmentary elevational view of roll biasing means taken along line 3—3 of FIG. 2.

As typically shown in FIG. 3, a spring assembly includes tubular segments 72–73 and may be the same as that described earlier in connection with spreader rolls 30, 31. Typically, a spring 74 is suitably secured at its ends to retainers 75 each adjustably mounted in tubular segments 72–73 by means of fasteners 76 to exert an inwardly (relative said panel) directed force on the coupled pair of side rolls. Biasing forces may be adjusted by repositioning and securing of the spring retainers 75. Other arrangements may be provided for biasing side rolls into panel edge engagement as, for example, the use of paired pneumatic cylinders each acting on an opposed roll with the pressure sides of each cylinder in communication with one another to equalize roll biasing forces and thereby compensating for panels on a path somewhat offset from a true path.

Figure 4:
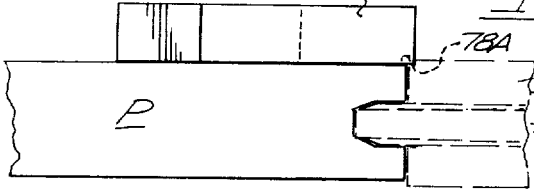
FIG. 4 is an elevational fragmentary view taken along line 4—4 of FIG. 2 and showing a fence engageable with an edge of a panel upper surface.

In FIG. 4 I show one of a pair of elongate barriers 78 in surface contact with the panel face at the sides thereof. Each barrier is supported in place by brackets 80 and serves to prevent the migration of sealant from a panel edge back to a panel face during functioning of the side applicator pressure rolls 56–59 and 60–63. To accomplish this, each barrier 78 overlies the outer edge of the moving panel face with arcuate recesses, as at 78A, spaced along the barrier, admitting an arc of a pressure roll. Accordingly, the upper face of the panel adjacent each side is kept free of displaced sealant.

Finish rolls 21–22 act on the panel faces after side roll passage to dress off any irregular amount of sealant on either panel face. Panel surfaces are subsequently dried by exposure to the atmosphere or drying equipment during travel to a stacking location.

The present method of applying sealant to the irregular surfaces constituting panel sides includes the sides of the moving panel and spreading the sealant over all of the surfaces comprising the panel sides. Subsequently, pressure as by side located rolls is imparted to the coated panel sides in a sequential manner and at points spaced along the paths of the panel sides to impregnate the panel sides with the sealant. Desirably, an initial step includes the application of viscous sealant to the panel faces. Further, to prevent the return of sealant to the panel faces during the application of pressure by the side rolls, an additional step may include the confining of sealant to the panel sides by the simultaneous application of pressure to the panel faces.

The sealant used may be of the solvent base type to assure expeditious drying of the treated panel with use of a water base being feasible but with an increased drying time.

The operation of the present apparatus and method of sealant application is believed readily apparent from the foregoing description.

While we have shown and described but one form of the invention it will be apparent to those skilled in the art that the invention may be embodied still otherwise without departing from the spirit and scope of the invention.

Having thus described the invention, what is claimed and desired to be secured under a Letters Patent is:

1. An apparatus for surface impregnating a tongue and groove panel having upper and lower faces and irregular sides with each side being a composite of vertical, horizontal and inclined surfaces, said apparatus comprising, a base including panel transfer means, applicator means on said base and applying a liquid to the panel faces, spreader means stationed along the paths of the panel side surfaces to disperse liquid thereover, side applicator rolls stationed in series along the base and each series in the path of a panel side with rolls acting sequentially on the panel sides, the rolls of each series being of irregular annular configuration, a first series of rolls treating the groove side of the panel and including a roll having a vertical outer wall for biased contact with a vertical panel side surface, a roll having multiple vertical walls for biased contact with panel vertical side surfaces, roll means having horizontal and inclined annular walls for contact with corresponding surfaces of the panel groove side, a second series of rolls treating the tongue side of the panel and including a roll having a vertical inner wall for biased contact with the outermost vertical surface of the panel tongue, a roll having multiple vertical walls for biased contact with vertical panel side surfaces above and below the panel tongue, roll means having horizontal and inclined annular side walls for contact with corresponding surfaces of the panel tongue, and adjustable biasing means acting on said side applicator rolls and said roll means urging same toward the panel sides.

2. The apparatus claimed in claim 1 wherein said spreader means are embodied in rolls one each located along the path of a panel side, biasing means acting on the spreader rolls.

3. The apparatus claimed in claim 1 wherein said spreader means are embodied in arms one each located along the path of a panel side, biasing means acting on each of the spreader arms.

4. The apparatus claimed in claim 1 wherein said biasing means is coupled to at least two side applicator rolls each of a different series and on opposite sides of a panel being treated so as to equalize pressure of the two rolls against the panel sides regardless of slight changes in the paths of the panel sides.

5. The apparatus claimed in claim 1 wherein said biasing means includes spring tensioned members.

6. The apparatus claimed in claim 1 additionally including barriers in surfacial contact with a panel face and preventing migration of liquid under the influence of the side applicator rolls from a panel side to a panel face.

7. The apparatus claimed in claim 1 wherein said biasing means includes pneumatic cylinders.

8. The apparatus claimed in claim 7 wherein said cylinders are arranged in pairs spaced transversely of the path of the panel with the cylinders of each pair in communication with one another and with a pressure source so as to equalize roll biasing forces of a pair of cylinders.

* * * * *